US006202965B1

(12) United States Patent
Chong

(10) Patent No.: US 6,202,965 B1
(45) Date of Patent: Mar. 20, 2001

(54) PANEL FASTENING SYSTEM FOR MODULAR OFFICE FURNITURE

(75) Inventor: Jonathan Chee Yeen Chong, Chicago, IL (US)

(73) Assignee: The Marvel Group, Inc., Chicago, IL (US)

( * ) Notice: Subject to any disclaimer, the term of this patent is extended or adjusted under 35 U.S.C. 154(b) by 0 days.

(21) Appl. No.: 09/274,510

(22) Filed: Mar. 23, 1999

Related U.S. Application Data

(60) Provisional application No. 60/113,188, filed on Dec. 21, 1998.

(51) Int. Cl.[7] ..... A47B 96/06

(52) U.S. Cl. ..... 248/220.43; 52/36.6; 248/243

(58) Field of Search ..... 248/220.21, 221.11, 248/243, 245, 220.43, 222.11; 52/36.6, 258; 211/193; 108/108

(56) References Cited

U.S. PATENT DOCUMENTS

| | | | |
|---|---|---|---|
| 2,127,280 | | 8/1938 | Zimbalist . |
| 2,534,952 | | 12/1950 | Comer . |
| 2,956,688 | | 10/1960 | Galassi . |
| 3,353,684 | | 11/1967 | Chesley . |
| 3,601,432 | | 8/1971 | Fenwick et al. . |
| 3,666,303 | | 5/1972 | Huls . |
| 3,730,108 | | 5/1973 | Stroh . |
| 3,794,281 | | 2/1974 | Munsey ..... 211/187 X |
| 3,966,158 | | 6/1976 | Boundy ..... 248/243 |
| 4,048,768 | * | 9/1977 | Good ..... 248/243 X |
| 4,133,433 | | 1/1979 | Wolf ..... 248/243 X |
| 4,154,419 | * | 5/1979 | Breidenbach ..... 248/243 |
| 4,171,789 | | 10/1979 | Vander Hoek et al. ..... 248/243 |
| 4,198,913 | | 4/1980 | Haworth et al. ..... 248/243 X |
| 4,387,872 | | 6/1983 | Hogue ..... 248/221.3 |
| 4,971,281 | | 11/1990 | Steinbeck ..... 248/225.2 |
| 5,116,007 | | 5/1992 | Von Gunton et al. ..... 248/243 |
| 5,135,194 | * | 8/1992 | Laughon et al. ..... 248/243 |
| 5,433,327 | | 7/1995 | Benvenuti et al. ..... 211/193 |
| 5,494,246 | | 2/1996 | McCarthy et al. ..... 248/221.11 |
| 5,538,213 | | 7/1996 | Brown ..... 248/222.11 |

* cited by examiner

*Primary Examiner*—Ramon O. Ramirez
(74) *Attorney, Agent, or Firm*—Edgar A. Zarins; Lloyd D. Doigan

(57) ABSTRACT

A modular office system incorporating wall panels with interlock edges to facilitate assembly. The substantially planar panels include a plurality of tabs extending from one side edge of the panel. The tabs are lockingly received within corresponding slots of an upright support member. To prevent disconnection of the panels, a retractable fastener bar can be selectively slid into locking engagement with the support member. The fastener bar is positioned within the panel and movable between a retracted position and an extended position engaging the upright support. A threaded fastener may be used to prevent sliding movement of the bar.

19 Claims, 4 Drawing Sheets

PANEL FASTENING SYSTEM FOR MODULAR OFFICE FURNITURE

This application claims the benefit of U.S. Provisional Patent Application Ser. No. 60/113,188 filed Dec. 21, 1998.

BACKGROUND OF THE INVENTION

I. Field of the Invention

This invention relates to modular office furniture and, in particular, to a secure locking system for contiguous panels of the furniture which allows such panels to be used in either orientation.

II. Description of the Prior Art

Modular office systems have become increasingly popular for their ease of installation and relatively low cost in association with the flexibility such systems provide. Office cubicles, desks and partitions can be easily rearranged or disassembled as personnel requirements change. However, these office systems must also be stable enough to withstand continuous use while also being capable of delivering essential utilities such as electrical power, telephones and computer networking. Because of the modular construction of such office systems, supplying such utilities must be conveniently accomplished. It is also desirable to organize the utility wiring throughout the modular system to facilitate repair or replacement.

Prior known office systems are very rigid in their construction variations. Typically, a frame is provided to which appropriate panels, drawers and desktops are mounted. Wiring may be run through the frame or between panels. connected to form cubicles and partitions are configured for assembly in only one orientation. This requires the manufacture and inventory of two sets of panels to allow complete assembly of an office system.

SUMMARY OF THE PRESENT INVENTION

The present invention overcomes the disadvantages of the prior known modular office system by providing modular panels which may be assembled in either of a dual orientation and locked together to prevent inadvertent disconnection.

The furniture panels which are assembled to form a modular office system such as partitions and cubicles have a substantially planar configuration with a floor engaging bottom edge and a finished top edge. The panel includes at least one side edge which facilitates connection to a contiguous panel. Intermediate panels will include two side edge connections while an end panel will include a finished side edge for aesthetic purposes.

The side edge of the panel will include a plurality of T-shaped tabs adapted to be received in corresponding slots of an upright frame member. Upon inserting the tabs into the slots, the panel is shifted downwardly so as to lock the cross-portion of the tab behind the slot. To prevent inadvertent disconnection of the panel, a fastener bar is deployed to prevent movement of the panel. The bar is laterally shiftable from within the panel to an extended position engaging the upright frame member.

Other objects, features and advantages of the invention will be apparent from the following detailed description taken in connection with the accompanying drawings.

BRIEF DESCRIPTION OF THE DRAWING

The present invention will be more fully understood by reference to the following detailed description of a preferred embodiment of the present invention when read in conjunction with the accompanying drawing, in which like reference characters refer to like parts throughout the views and in which.

DETAILED DESCRIPTION OF A PREFERRED EMBODIMENT OF THE PRESENT INVENTION

Figure 1B:
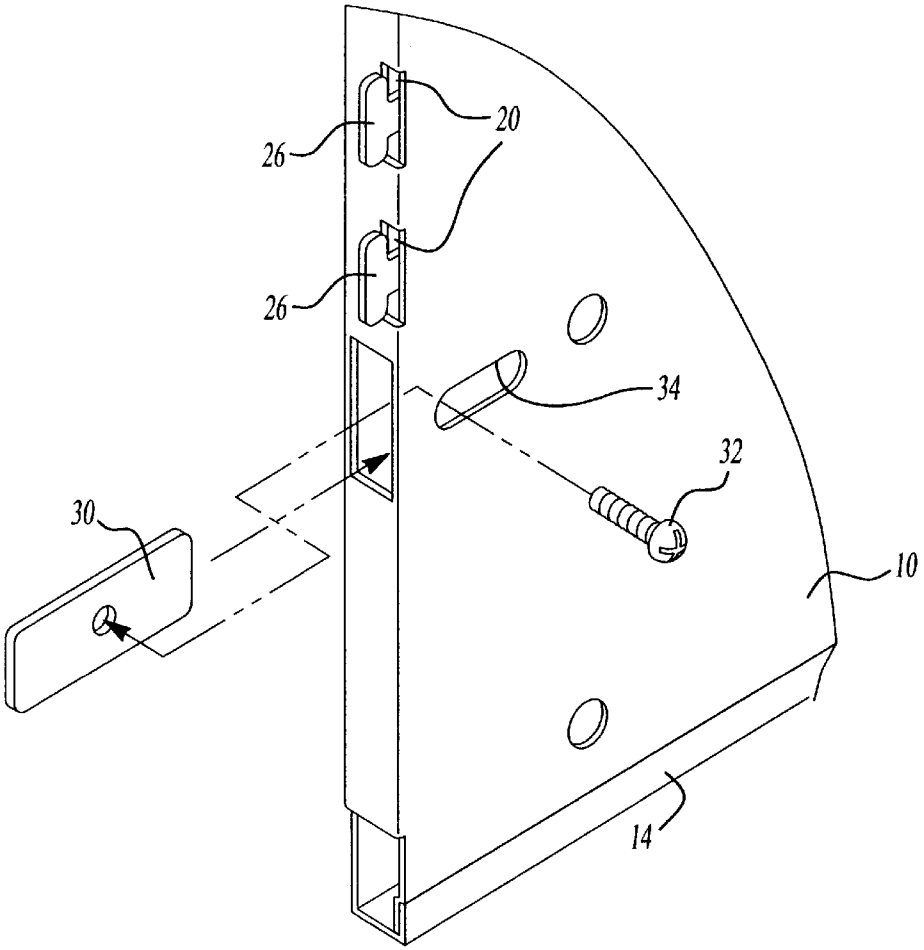
FIG. 1 is a perspective view of a panel for forming a modular furniture system and including a fastening system embodying the present invention.
Figure 1A:
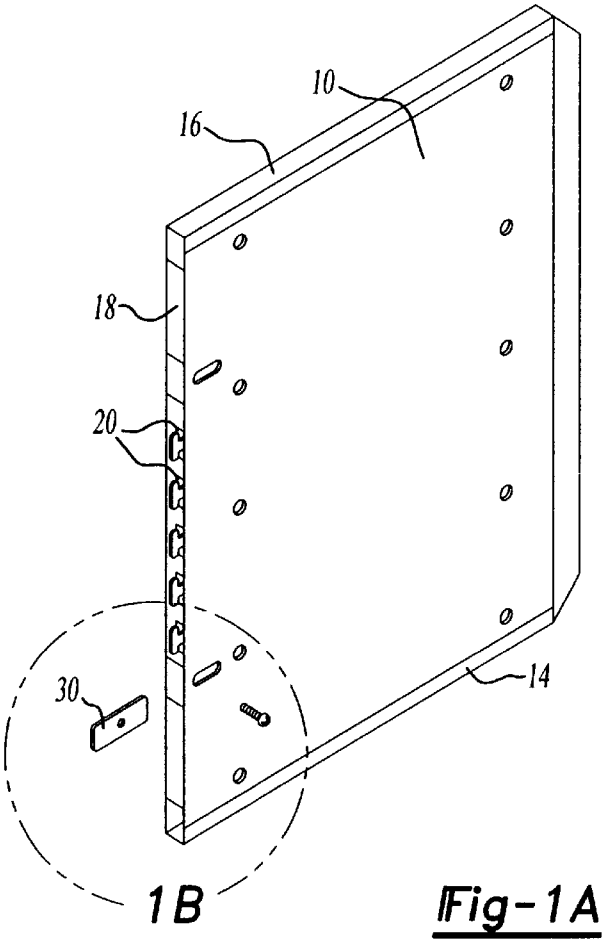
Figure 2:
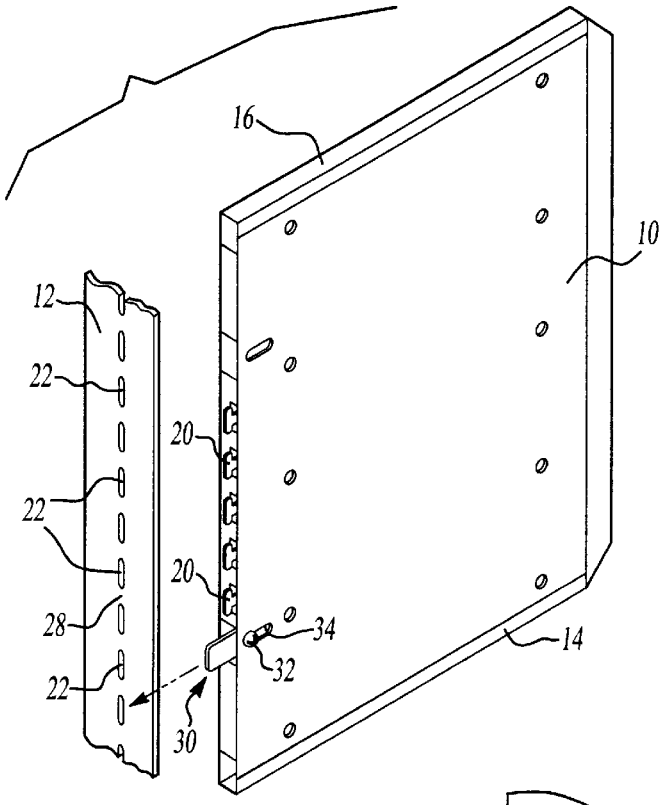
FIG. 2 is a perspective view of the panel being joined with an upright support member.
Figure 3A:
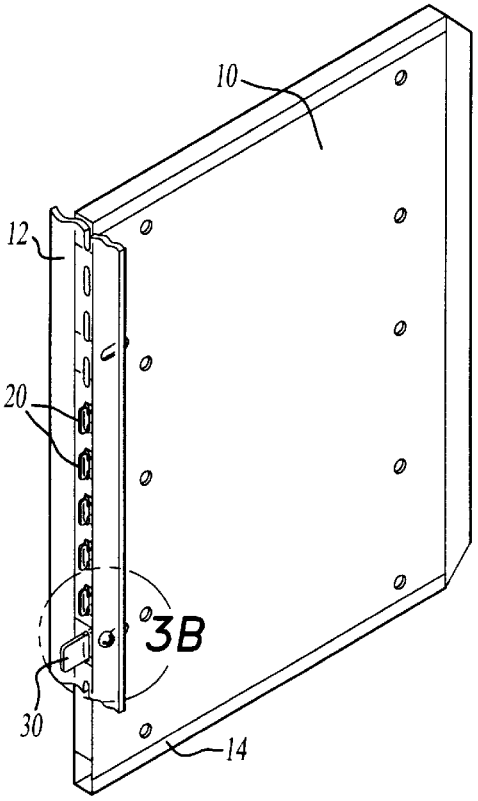
FIG. 3 is an enlarged view of the panel joined to the upright support.
Figure 3B:
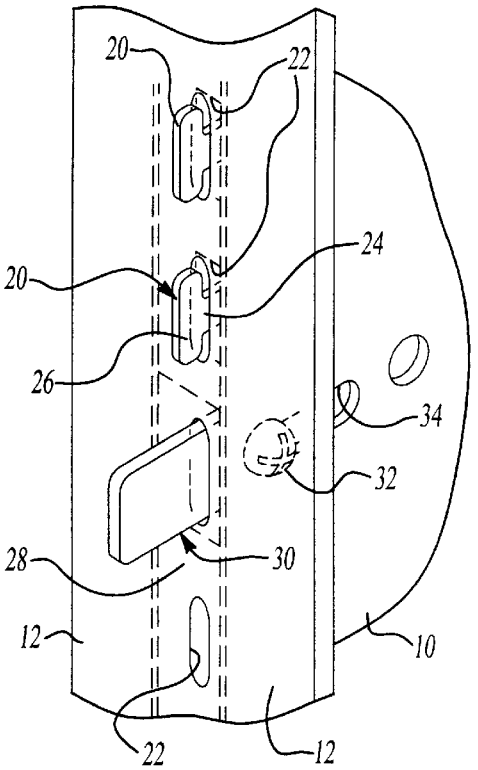

Referring first to FIGS. 1 through 3, there is shown a modular panel 10 for forming an office furniture system such as a cubicle or partition. In a preferred embodiment, a plurality of panels 10 are joined to form the required cubicle or partition. The panels 10 are detachably connected to upright support member 12 which support the panels 10 along the floor.

The panels 10 have a substantially planar configuration with a floor engaging bottom edge 14 and a finished top edge 16. At least one of the side edges 18 includes a plurality of connector tabs 20. In the case of an intermediate panel, connector tabs 20 will be formed along bottom side edges 18. For an end panel, only one such edge 18 will include connector tabs 20 while the outside termination edge will be finished for aesthetic purposes (FIG. 1). The connector tabs 20 are spaced along the side edge 18 and correspond to slots 22 formed in the upright support member 12. In a preferred embodiment, the connector tabs 20 have a T configuration with an outwardly extending transverse portion 24 and a cross portion 26. The connector tabs 20 are configured such that upon insertion into the slots 22, the panel 10 can be shifted downwardly to move the cross portion 26 behind the wall 28 for the slots 22. Accordingly, the tabs 20 cannot be withdrawn from the slots 22 without first shifting the panel 10 upwardly. Moreover, by utilizing a T-shaped tab 20, the panel 10 can be employed in a dual orientation, eg. flipping the panel 10 over such that the finished outer edge is on the opposite side of the support 12.

Once the panel 10 is connected to the upright support member 12, a fastener bar 30 is deployed to prevent shifting the panel 10 top extract the tabs 20. During assembly of the panel 10 to the support 12, the fastener bar 30 is retracted within the panel 10. Upon assembly, the bar 30 can be extended from the interior of the panel 10 and into a corresponding slot 22 in the upright 12. Since the bar 30 has the same width as the length of the slot 22, upon insertion of the bar 30 the panel 10 will not be shiftable relative to the support 12. The bar 20 is secured within the panel 10 by a threaded fastener 32 which is received in a lateral slot 34 facilitating retraction and extension of the bar 30.

Figure 4B:
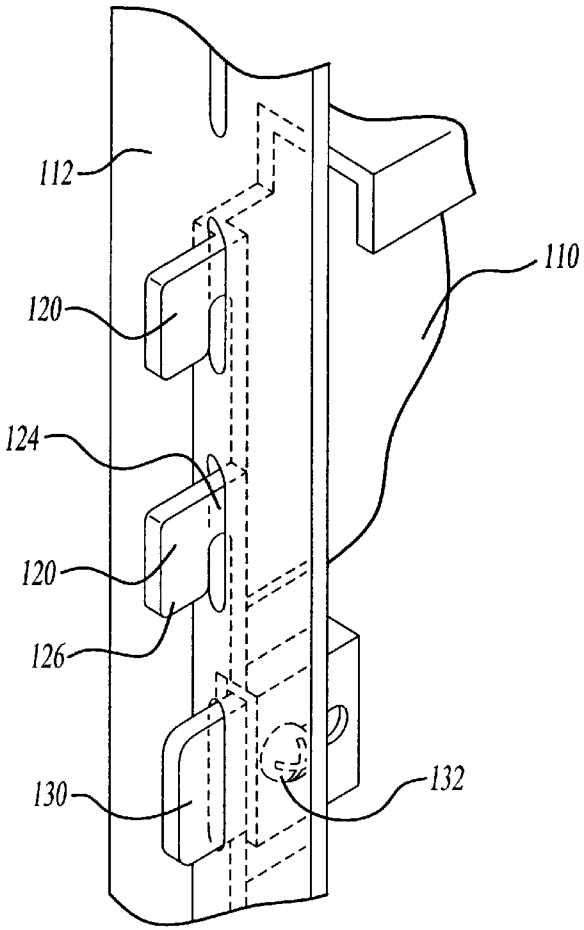
FIG. 4 is a perspective view of a shelf bracket incorporating the fastener bar of the present invention.
Figure 4A:
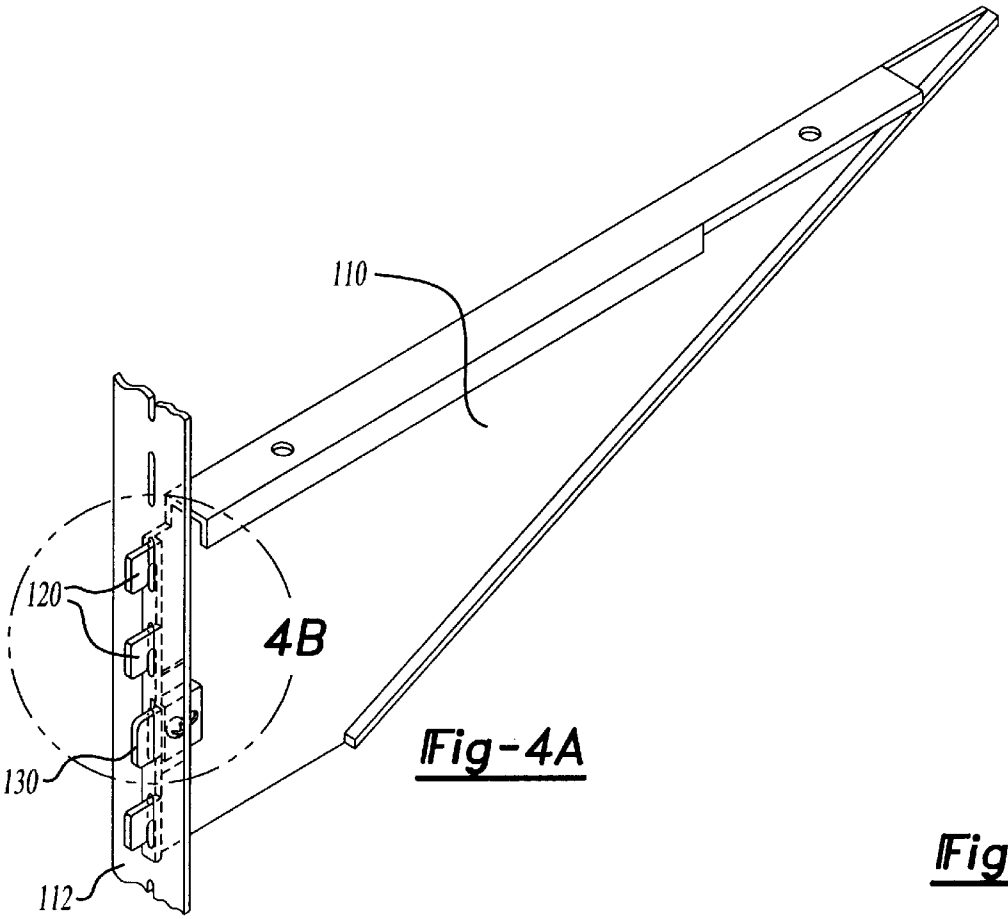
Figure 5:
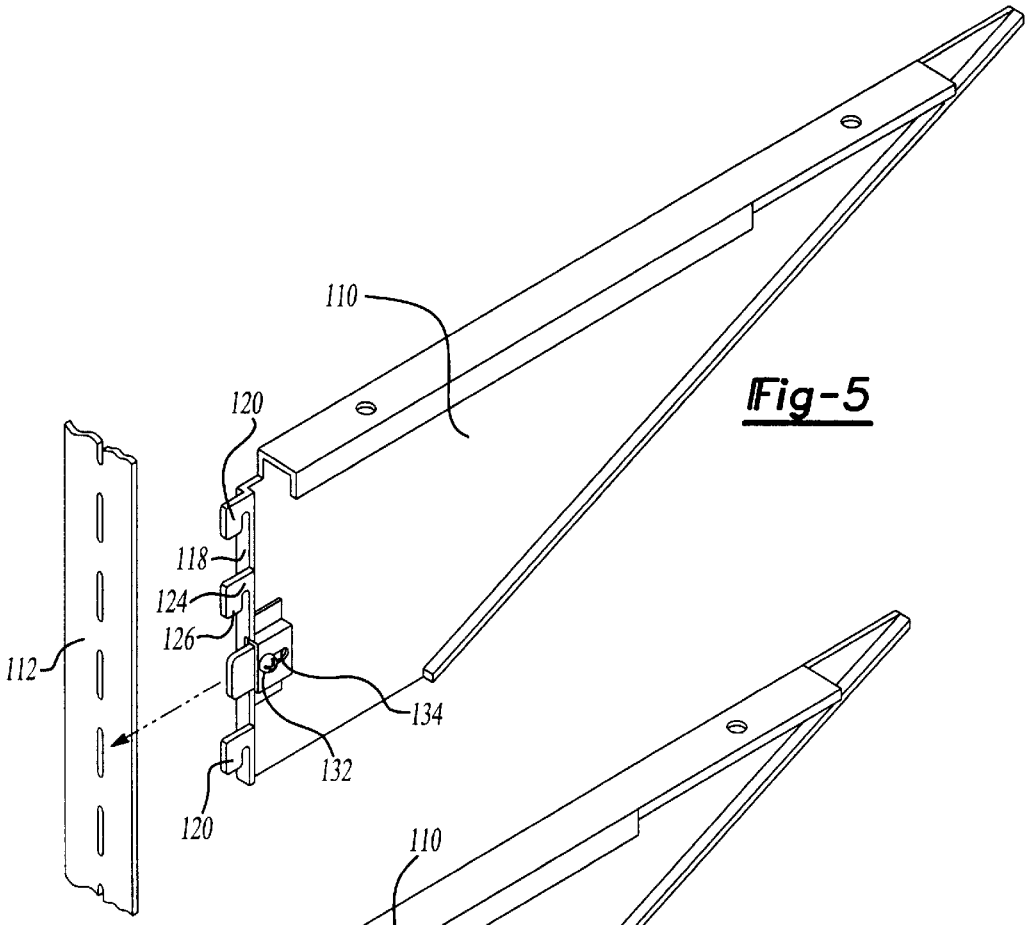
FIG. 5 is an exploded view of the shelf bracket being joined to an upright support.
Figure 6A:
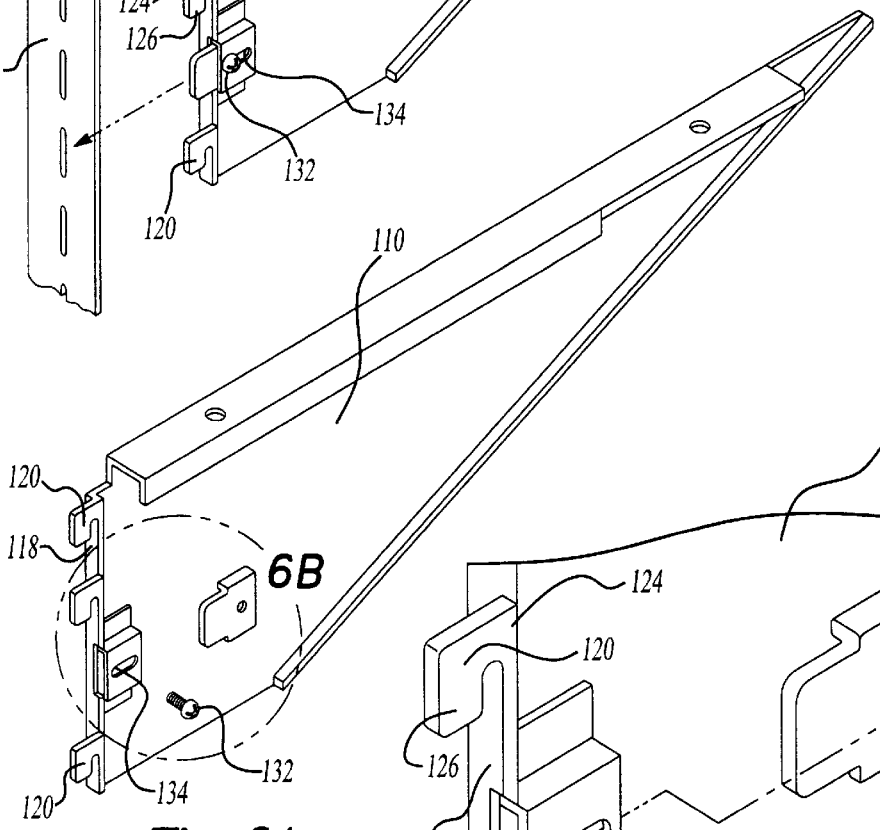
FIG. 6 is an enlarged view of the fastener bar employed in the shelf bracket.
Figure 6B:
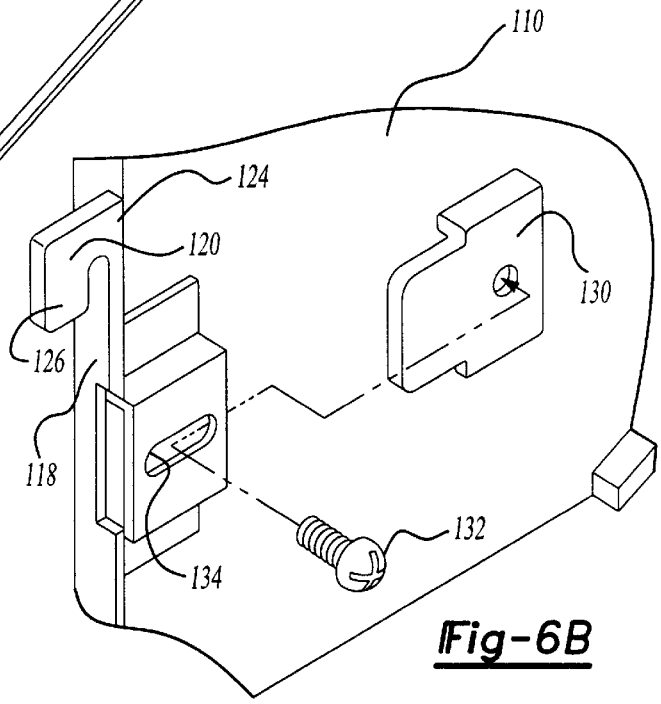

In an alternative embodiment shown in FIGS. 4 through 6, a fastener bar 130 is utilized to secure a shelf bracket 110 to an upright support 112. The shelf bracket 110 includes a side edge 118 having a plurality of spaced apart connector tabs 120. Preferably, the connector tabs 120 have an L configuration with an outwardly extending portion 124 and a cross portion 126 formed perpendicular to portion 124. After inserting the tabs 120 into the corresponding slots 122 of the support 112, the bracket 110 is shifted downwardly to move the cross portion behind the wall 128. Thereafter, the fastener bar 130 may be extended into a slot 122 to prevent shifting of the bracket 110. The bar 130 is secured by a threaded fastener 132 extending through lateral slot 134. In order to remove the bracket 110, the fastener bar 130 must be retracted from slot 122 allowing the bracket 110, the fastener bar 130 must be retracted from slot 122 allowing the bracket 110 to be shifted upwardly for extraction of the connector tabs 120.

The foregoing detailed description has been given for clearness of understanding only and no unnecessary limitations should be understood therefrom as some modifications will be obvious to those skilled in the at without departing from the scope and spirit of the appended claims.

What is claimed is:

1. In an assembly of planar members including a first planar member having a plurality of apertures and a second planar member having a corresponding plurality of tabs selectively lockingly received within said aperatures to connect said first planar member and said secured planar member, the improvement comprising:

a fastening system for selectively preventing removal of said tabs from said apertures to secure said panels in contiguous relation, said fastening system including a selectively retractable locking member disposed within said second planar member and selectively extendable into an aperture of said first planar member non occupied by any of said plurality of tabs preventing movement of one of said panels relative to the other of said panels, said locking member including a locking tab longitudinally movable between a retracted position and an extended position protruding from an edge of said second planar member for mating insertion into said aperture of said first planar member.

2. The fastening system as defined in claim 1 wherein said locking tab is slidably disposed within said second planar member for selective movement between said retracted position disposed within said second planar member and said extended position.

3. The fastening system as defined in claim 2 wherein said locking tab is slidably secured within said second planar member by a fastener threadably attached to said locking tab and disposed in a lateral slot of said second planar member such that movement of said fastener along said slot moves said locking tab between said retracted and extended positions.

4. The fastening system as defined in claim 3 wherein said first planar member is a panel for a modular office furniture assembly, said panel having a plurality of apertures along an outer edge thereof.

5. The fastening system as defined in claim 3 wherein said first planar member is an upright support member, for a modular office furniture assembly, said upright support member having a plurality of apertures along an outer edge thereof for receiving said tabs of said second planar member.

6. The fastening system as defined in claim 5 wherein said second planar member is a panel for a modular office furniture assembly, said plurality of tabs formed along an outer edge of said panel for selective mating engagement with said apertures of said first planar member.

7. The fastening system as defined in claim 5 wherein said second planar member is a shelf bracket with said plurality of tabs formed along an outer edge thereof.

8. The fastening system as defined in claim 5 wherein said plurality of tabs have a T-shaped configuration for locking engagement with said apertures.

9. The fastening system as defined in claim 5 wherein said plurality of tabs have an L-shaped configuration for locking engagement with said apertures.

10. A fastening system for construction of a modular office furniture assembly, said fastening system comprising:

a first panel member having a plurality of apertures along an outer edge of said first panel member;

a second panel member having a plurality of tabs selectively lockingly received within said apertures to join said first and second panel members; and a selectively retractable locking member disposed within said second panel member and selectively longitudinally movable between a retracted position within said second panel member and an extended position matingly engaging an aperture of said first panel member non occupied by any of said plurality of tabs such that removal of said tabs of said second panel member from said first panel member is prevented.

11. The fastening system as defined in claim 10 wherein said locking member is slidably secured within said second panel member by a fastener threadably attached to said locking member and movably disposed in a lateral slot of said second planar member such that movement of said fastener along said slot moves said locking member between said retracted and said extended positions.

12. The fastening system as defined in claim 11 wherein said plurality of tabs have a T-shaped configuration for locking engagement with said apertures of said first panel member.

13. The fastening system as defined in claim 11 wherein said plurality of tabs have an L-shaped configuration for locking engagement with said apertures of said first panel member.

14. The fastening system as defined in claim 11 wherein said first planar member is an upright support member for the modular office furniture assembly, said upright support member having a plurality of apertures along an outer edge of receiving said tabs of said second planar member.

15. The fastening system as defined in claim 14 wherein said second planar member is a panel for a modular office furniture assembly, said plurality of tabs disposed along an outer edge of said panel for selective mating engagement with said apertures of said first planar member, said locking member disposed along said outer edge proximate said tabs.

16. The fastening system as defined in claim 14 wherein said second planar member is a shelf support for a modular office furniture assembly, said plurality of tabs disposed along an outer edge of said support for selective mating engagement with said apertures of said first planar member, said locking member disposed along said outer edge proximate said tabs.

17. In an assembly of planar members including a first planar member having a plurality of apertures and a second planar member having a corresponding plurality of tabs selectively lockingly received within said apertures to connect said first planar member and said secured planar member, the improvement comprising:

a fastening system for selectively preventing removal of said tabs from said apertures to secure said panels in contiguous relation, said fastening system including a selectively retractable locking member disposed within said second planar member and selectively extendable into an aperture of said first planar member non occupied by any of said plurality of tabs preventing movement of one of said panels relative to the other of said panels, said locking member including a locking tab longitudinally movable between a retracted position and an extended position protruding from an edge of said second planar member for mating insertion into said aperture of said first planar member;

whereby said locking tab is removable from within said second planar member for repositioning such that said second planar member may be reoriented relative to said first planar member.

18. The fastening system as defined in claim 17 wherein said locking tab is slidably secured within said second planar member by a fastener threadably attached to said locking tab and disposed in a lateral slot of said second planar member such that movement of said fastener along said slot moves said locking tab between said retracted and extended positions.

19. The fastening system as defined in claim 18 wherein said plurality of tabs have a T-shaped configuration for locking engagement with said apertures.

* * * * *